US005730218A

United States Patent [19]

Swagerty et al.

[11] Patent Number: 5,730,218

[45] Date of Patent: Mar. 24, 1998

[54] TOOL PROTECTION GUIDE WITH ENERGY ABSORBING BUMPER

[75] Inventors: Gerald Brian Swagerty; David Earl Cain, both of Houston; John Robert Herold, Cypress; Don B. Wafer, Spring; Randy Elum, Humble; Bashir M. Koleilat, Spring; Henry Wong, Houston, all of Tex.

[73] Assignee: FMC Corporation, Chicago, Ill.

[21] Appl. No.: 594,960

[22] Filed: Jan. 31, 1996

[51] Int. Cl.[6] ..... E21B 17/10

[52] U.S. Cl. ..... 166/241.1; 166/85.4; 166/85.5

[58] Field of Search ..... 166/241.7, 241.1, 166/241.5, 242.7, 85.3, 85.5, 85.4

[56] References Cited

U.S. PATENT DOCUMENTS

| | | | |
|---|---|---|---|
| 363,111 | 5/1887 | Brooder | 166/241.1 |
| 3,991,850 | 11/1976 | Escaron | 166/241.5 |
| 3,994,163 | 11/1976 | Rogers | 73/151 |
| 4,182,415 | 1/1980 | Harland et al. | 166/85.5 |
| 4,523,640 | 6/1985 | Wilson et al. | 166/241.5 |
| 4,595,055 | 6/1986 | Vannier | 166/241.5 |
| 5,226,333 | 7/1993 | Hess | 166/241.5 |
| 5,320,179 | 6/1994 | Roos, Jr. et al. | 175/26 |

FOREIGN PATENT DOCUMENTS 2178091 2/1987 United Kingdom .

*Primary Examiner*—Hoang C. Dang
*Attorney, Agent, or Firm*—Henry C. Query, Jr.

[57] ABSTRACT

According to the present invention, there is provided a device for guiding a tool on a string within a blow out prevention ("BOP") stack. In one embodiment, the device includes a top collar connected to a bottom collar by a shroud having a plurality of flexible members which bow outwardly from the collars, wherein the shroud covers a portion of the tool. An energy absorbing bumper is provided above the top collar to absorb structural impact caused by a blow out or other inadvertant pressure in a downhole application.

3 Claims, 11 Drawing Sheets

TOOL PROTECTION GUIDE WITH ENERGY ABSORBING BUMPER

FIELD OF THE INVENTION

This invention relates to the field of down-hole tools, and more particularly, to a device for guiding a down-hole tool through the bore of pipe or casing.

BACKGROUND OF THE INVENTION

In oil-field operations, there is frequently a need to run a well servicing tool from a rig down into a receptacle such as a tubing hanger. In off-shore operations the rig floor is located a substantial distance from the ocean floor where a sub-sea wellhead is located. Tools are run through a string from the rig down into the wellhead through a tube assembly such as a riser pipe or a blow out prevention ("BOP") stack. The down-hole tool is attached to a running string, such as a sucker rod, which is used to run the tool through the center of the stack and place it in connection with the desired receptacle, such as the tubing hanger. It is important that the tool is centered as it is being run through the stack. If it is not, the tool is likely to impact the internal sides of the stack and cause damage to the stack and the tool itself. Also, if the tool is not properly centered it may not properly align with the tubing hanger, thereby causing damage to the hanger and the tool.

Solid rigid metal centralizers have been designed for running and retrieving tools. However, these designs rely on the mass of the centralizer for alignment and do not actually protect the down-hole tool as it is being run through the stack. In addition, these non-flexible centralizers often hang up when an obstruction down-hole is encountered. For example, FIG. 1 shows an example of a solid metal centralizer. As shown, the centralizer 10 attaches to the string by threads 102 at one end, and has a down-hole tool 104 attached to an opposite end by threaded bore 106. As shown, down-hole tool 104 is completely exposed, as the centralizer travels downward through the stack. With this type of design some impact between the tool and the sides of the stack may occur, causing damage to the tool 104. These designs do not provide adequate alignment between the tool and the tubing hanger and, thus, further fail to prevent damage from contact between these two members.

Accordingly, there is a need in the art for a device for guiding a down-hole tool which overcomes the above-mentioned problems.

SUMMARY OF THE INVENTION

According to the present invention, there is provided a guide or centralizer for use with a down-hole tool in communication with a string. In one embodiment, the guide comprises a top collar connected to a bottom collar by a shroud having a plurality of flexible members which bow outwardly from the collars, wherein the shroud covers a portion of the tool. In a further embodiment, there is provided an energy absorbing bumper positioned above the top collar to protect structures within a BOP stack or riser from being damaged by the centralizer in the event of a blowout.

BRIEF DESCRIPTION OF THE DRAWINGS

For a more complete understanding of the invention and for further advantages thereof, reference is made to the following Detailed Description taken in conjunction with the accompanying drawings, in which.

It is to be noted, however, that the appended drawings illustrate only typical embodiments of this invention and are therefore not to be considered limiting of its scope, for the invention may admit to other equally effective embodiments.

DETAILED DESCRIPTION OF EMBODIMENTS OF THE INVENTION

Figure 1:
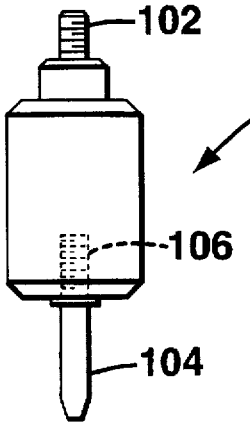
FIG 1 (PRIOR ART)
FIG. 1 is a plan view of a prior art solid metal centralizer.
Figure 2:
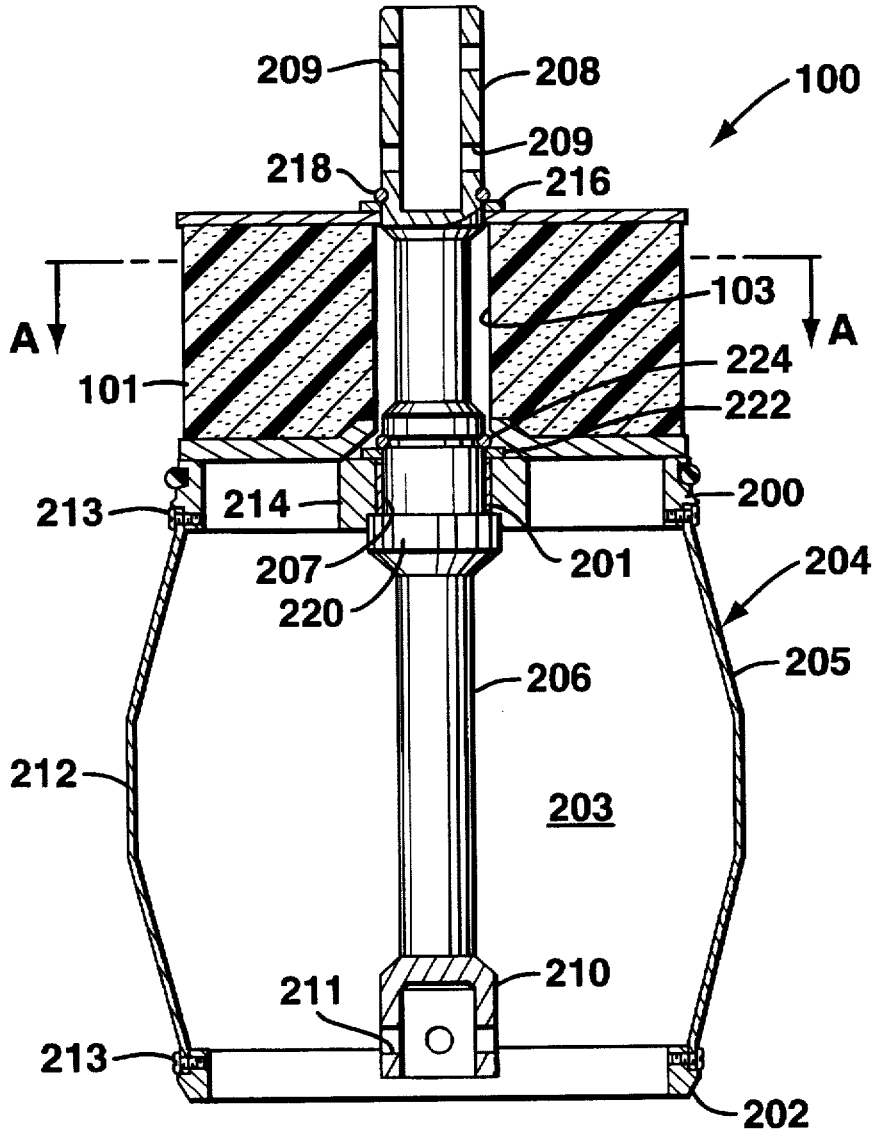
FIG. 2 is a cross-sectional view of an embodiment of the invention.

Referring now to FIG. 2, a guide or centralizer assembly 100 for use with a down-hole tool in communication with a string is provided according to the present invention. In one embodiment the guide comprises a top collar 200 connected to a bottom collar 202 by a shroud 204 having a mandrel 206 positioned within. For purposes of the following discussion, the operation of the guide will be described in connection with its use in raising and lowering a down-hole tool through a blow out prevention ("BOP") stack. However, this particular use is for purposes of illustration only, and those of skill in the art will recognize that the present invention is useful in connection with lowering a variety of down-hole tools through the bore of various oil-field tubular devices, such as riser pipe and casing.

In the FIG. 2 embodiment, the top end 208 of the mandrel 206 is adapted to attach to a running string (not shown) for installation and removal of a tool down-hole. The top end 208 may be provided with various known means to attach a running string including threads or bolt holes as shown at 209. Additionally, the top end 208 may be configured to receive various connection adapters (not shown) to facilitate attachment to running strings with known attachment means. Similarly, a down-hole tool (not shown) is connected to the bottom end 210 of the mandrel 206 which is also adapted to utilize a variety of known connection means. In the embodiment shown bolt holes 211 are provided for such connection.

Figure 2A:
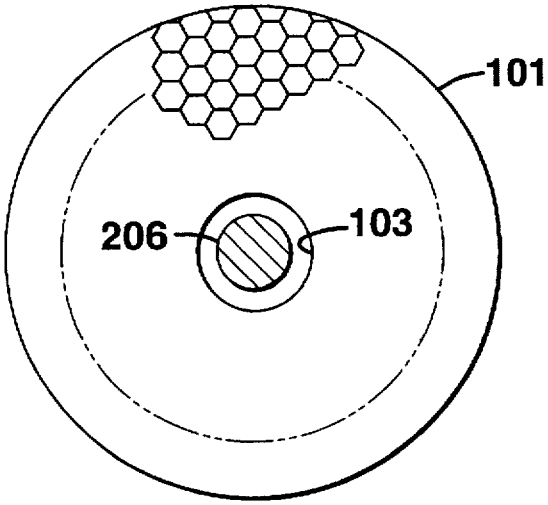
FIG. 2A is a cross-sectional view of the bumper feature of the present invention taken along line A—A of FIG. 2.

An energy absorbing bumper 101 having a central passage 103 therethrough for receiving the mandrel 106 is provided above the top collar 200. The bumper 101 is designed to absorb impact and/or collapse at a predetermined vertical load in order to protect or minimize damage to structures located above the bumper 101 during a blowout or pressure surge. The bumper comprises, preferably, a lightweight material having uniformly distributed strength and an ability to collapse upon impact or predetermined force and still maintain load bearing properties. One preferred material is an internal honeycomb structured aluminum or metal having a thin outer coating or foil to prevent corrosive or pressurized substances from entering and affecting strength and impact properties. As shown in FIG. 2A, such a material preferably comprises a plurality of hollow columns which are hexagonal in cross section. Any other suitable material, such as high density foam, may be used. As shown in FIG. 2, bumper 101 is preferably supported on an inner diameter section 214 of top collar 200 and is held in position by means of a washer 216 and garter spring 218, the latter of which is received in a corresponding groove in mandrel 206.

Space 203 encompassed by top 200 and bottom 202 collars and shroud 204, surrounds or covers a portion, or all, of the mandrel 206. Thus, as the mandrel 206 is being lowered through, for example, a blow out prevention ("BOP") stack, it is shielded from contact with the internal wall of the stack. If shroud 204 should come in contact with the internal wall of the stack (not shown), the tool will be prevented from impacting the internal wall of the stack due to the interference of shroud 204 with the internal wall.

The shroud 204 comprises individual flexible members such as bow springs 205 as shown. The bow springs 205 are flat flexible strips that are spaced evenly around the mandrel and fixed to the top 200 and bottom 202 collars. The mandrel 206 is received in the inside diameter 207 of the top collar 200. A bushing 201 received in the top collar 200 can be used to facilitate rotation of the mandrel 206 as needed to manipulate a particular running tool. As shown in FIG. 2, top collar 200 is supported on an enlarged diameter portion 220 of mandrel 206 and restrained from moving with respect thereto by a washer 222 and garter spring 224, the latter of which is positioned in a corresponding groove formed in mandrel 206. In the preferred embodiment each of the bow springs 205 are attached, by bolts 213 or similar means, to the outside diameter of the top 200 and bottom 202 collars. Any suitable number of flexible members or bow springs 205 can be used to achieve optimum weight, flexibility, resistance and centralizing properties. By way of example the embodiment of FIG. 2 utilizes four bow springs 205 equally spaced about the mandrel 206 at ninety degree intervals.

The bow springs 205 are provided with outermost surfaces 212 for engaging the internal surface of the stack. The surfaces 212 may be flat as shown, or they may have an apex or an arcuate profile. These surfaces 212 serve to centralize the shroud, and thus the tool, inside the stack, and are designed to flex inward if a restriction in the stack is encountered. This provides an advantage over solid metal centralizers in that the guide will be less likely to hang up, or be blocked, by a restriction because the flexible members can adjust as necessary. In this manner, a tool is protected from impact with the internal wall of the stack, while still remaining centered.

When-the guide reaches its destination, it is necessary for the down-hole tool to be able to disengage from the guide and then engage with a particular device or receptacle to be operated by the tool. This aspect of the invention is described more fully below.

Figure 3:
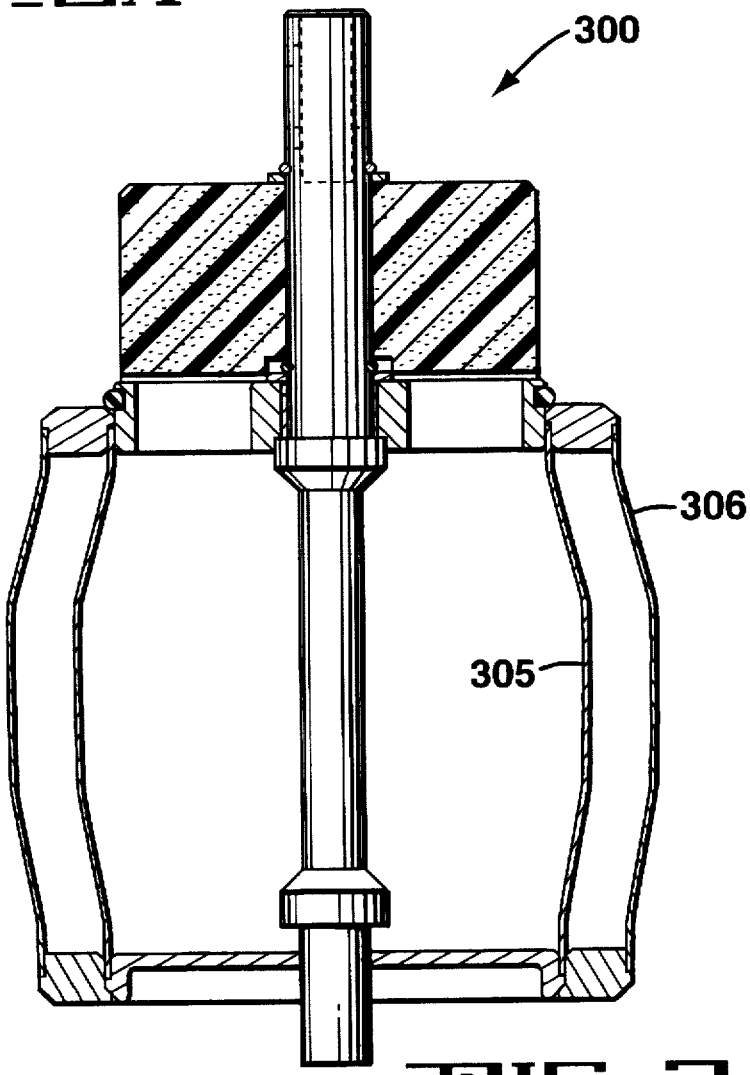
FIG. 3 is a cross-sectional view of another embodiment of the invention.

Illustrated in FIG. 3 is an alternative embodiment of the centralizer assembly 300 having double layers of bow springs 305 and 306 to accommodate wider internal diameters in the BOP stack. As shown in FIG. 3, springs 306 are secured to upper and low adapter collars 308, 310 to form an adapter 312 for larger diameter applications. Adapter collars 308, 310 are assembled over top and bottom collars 200, 202 of centralizer 100 and, and adapter 312 is held in place with respect to centralizer 100 by any suitable means, such as a garter spring 314 positioned in a corresponding groove in upper collar 200.

Figure 4:
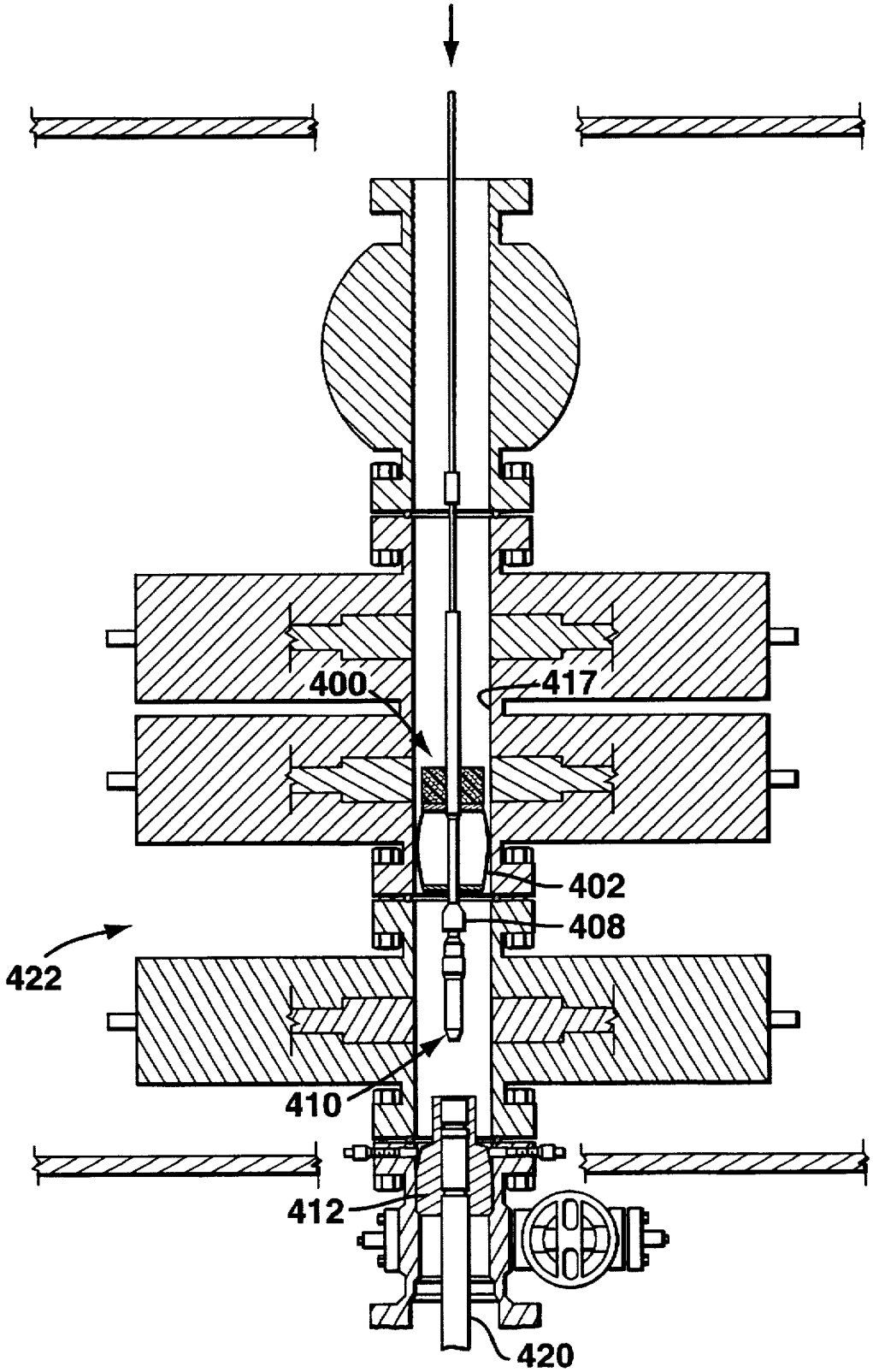
FIGS. 4 through 12 are plan views showing the operation of the invention according to one embodiment.

Beginning with FIG. 4 a sequence of placing and removing a back pressure valve (BPV) assembly 410 utilizing the present invention centralizer assembly 400 to guide a tool 408 is illustrated. The BPV 410 is installed into and removed from a tubing hanger 412 located in the end of riser pipe 420. Riser pipe 420 is in turn connected to BOP stack 422. It is to be understood that this particular embodiment is for illustrative purposes only, and those of skill in the art will recognize that the present invention is useful with a variety of different tools in different oil field applications.

As shown in FIG. 4, the centralizer 400 with the BPV 410 attached is lowered through the BOP 422 toward the tubing hanger 412. The shroud 402 engages the inner walls 417 of the stack 418 to center tool 408 with the center of tubing hanger 412.

Figure 5:
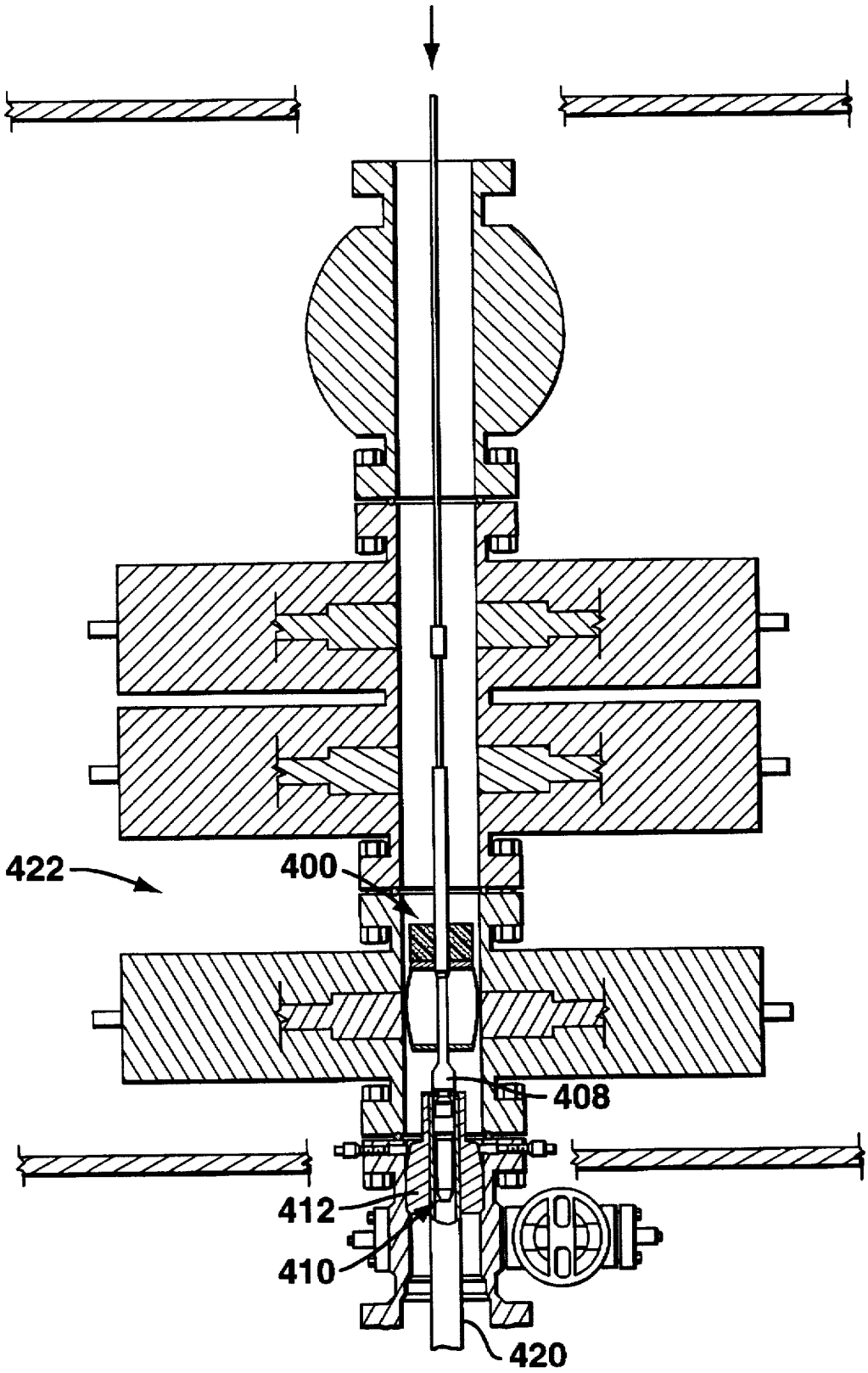
Figure 6:
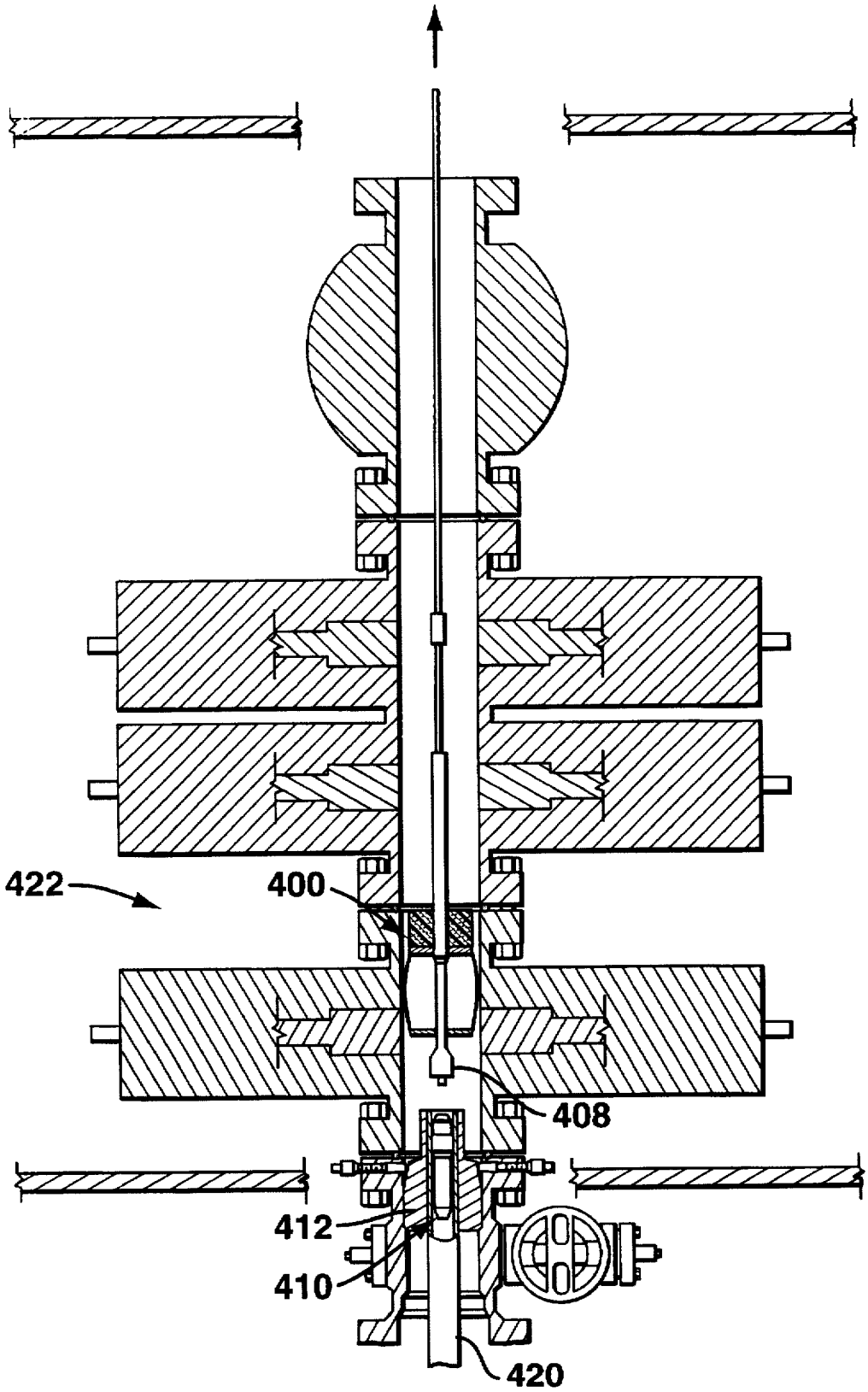
Figure 7:
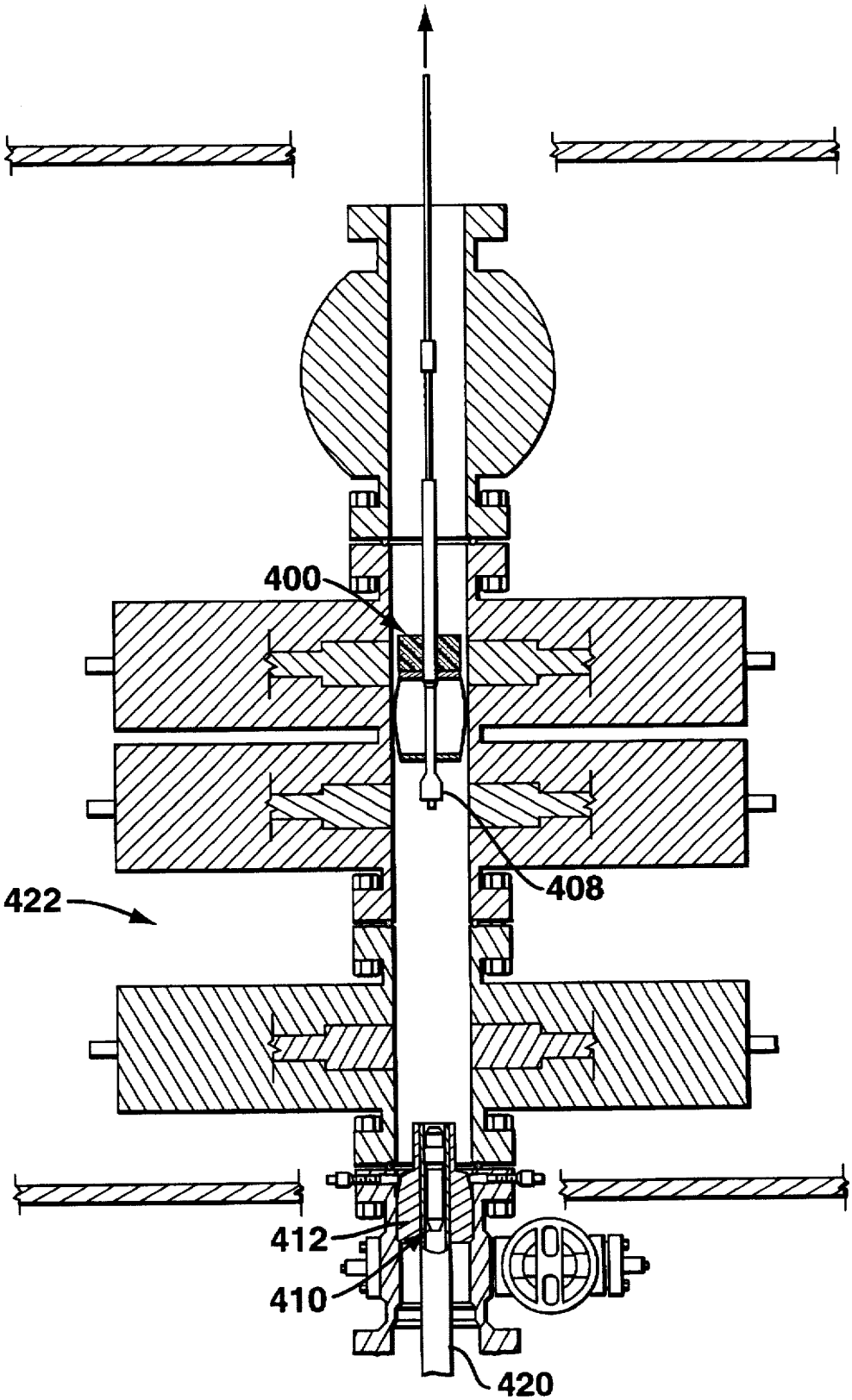

FIG. 5 shows the BPV 410, while still attached to the running tool 408, positioned in the tubing hanger 412. FIGS. 6 and 7 illustrate the BPV 410 in place in the tubing hanger 412 after the BPV is separated from the running tool 408 by shearing a pin (not shown) in a conventional stinger and shear pin assembly.

Figure 8:
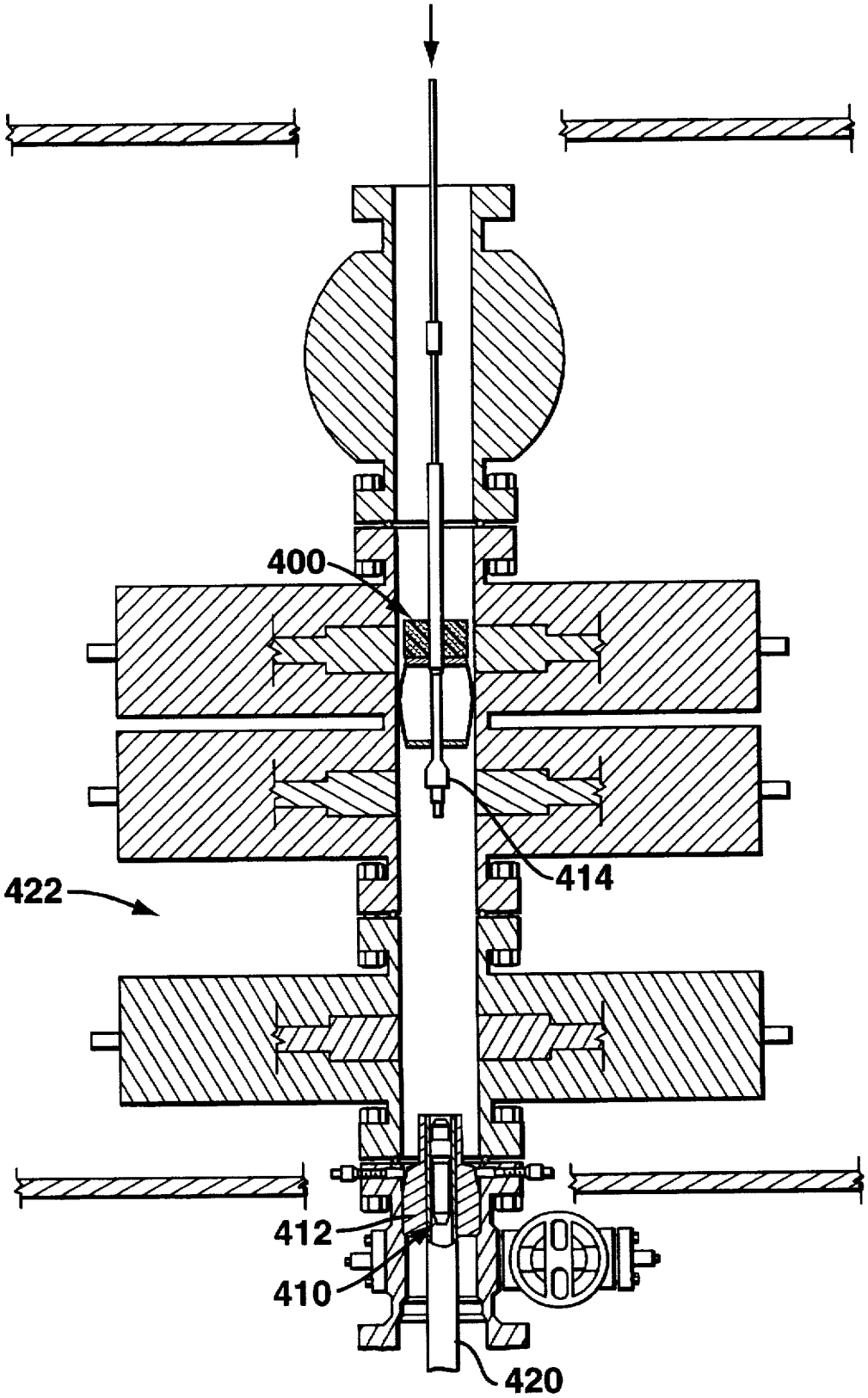
Figure 9:
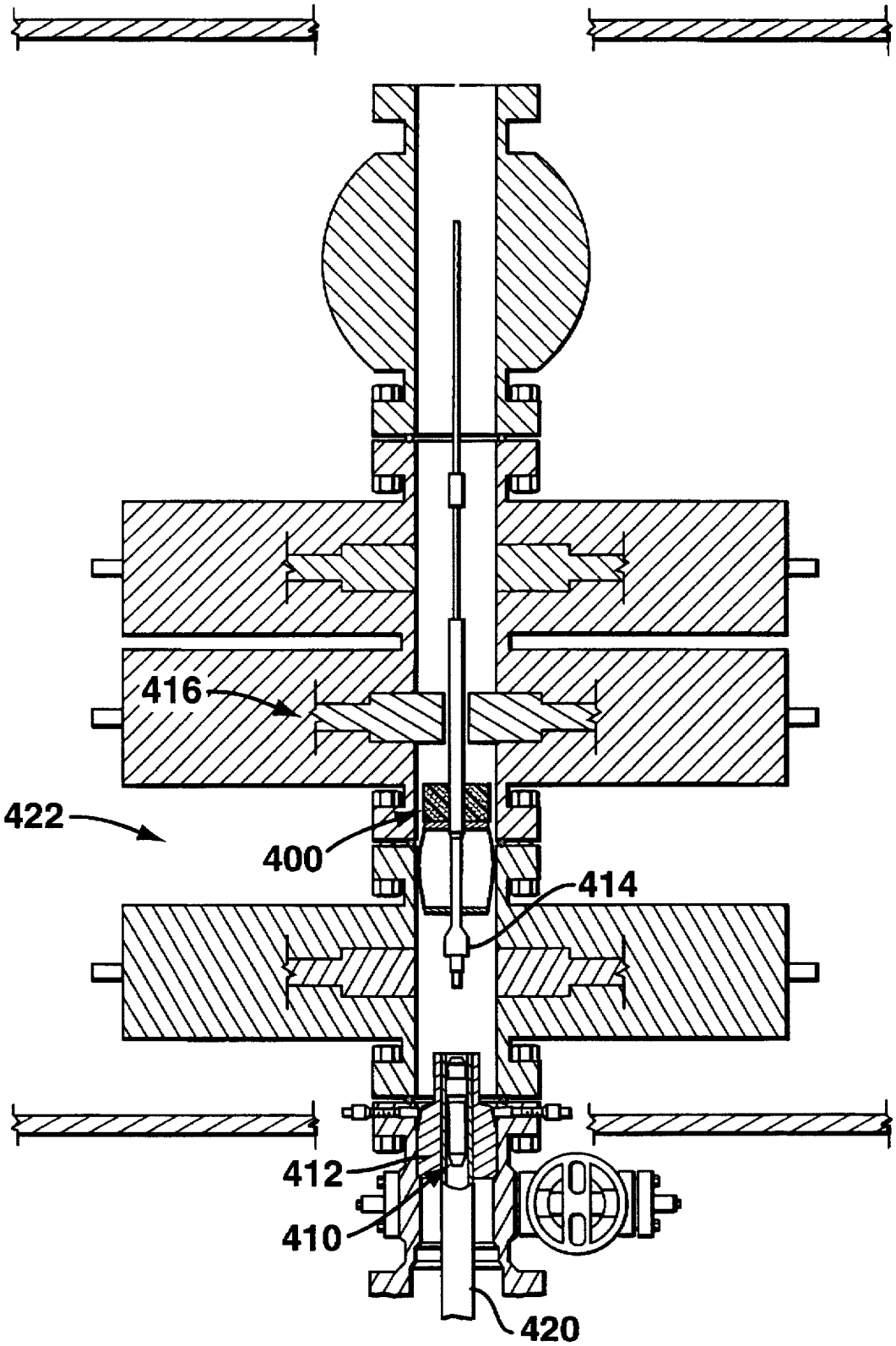
Figure 10:
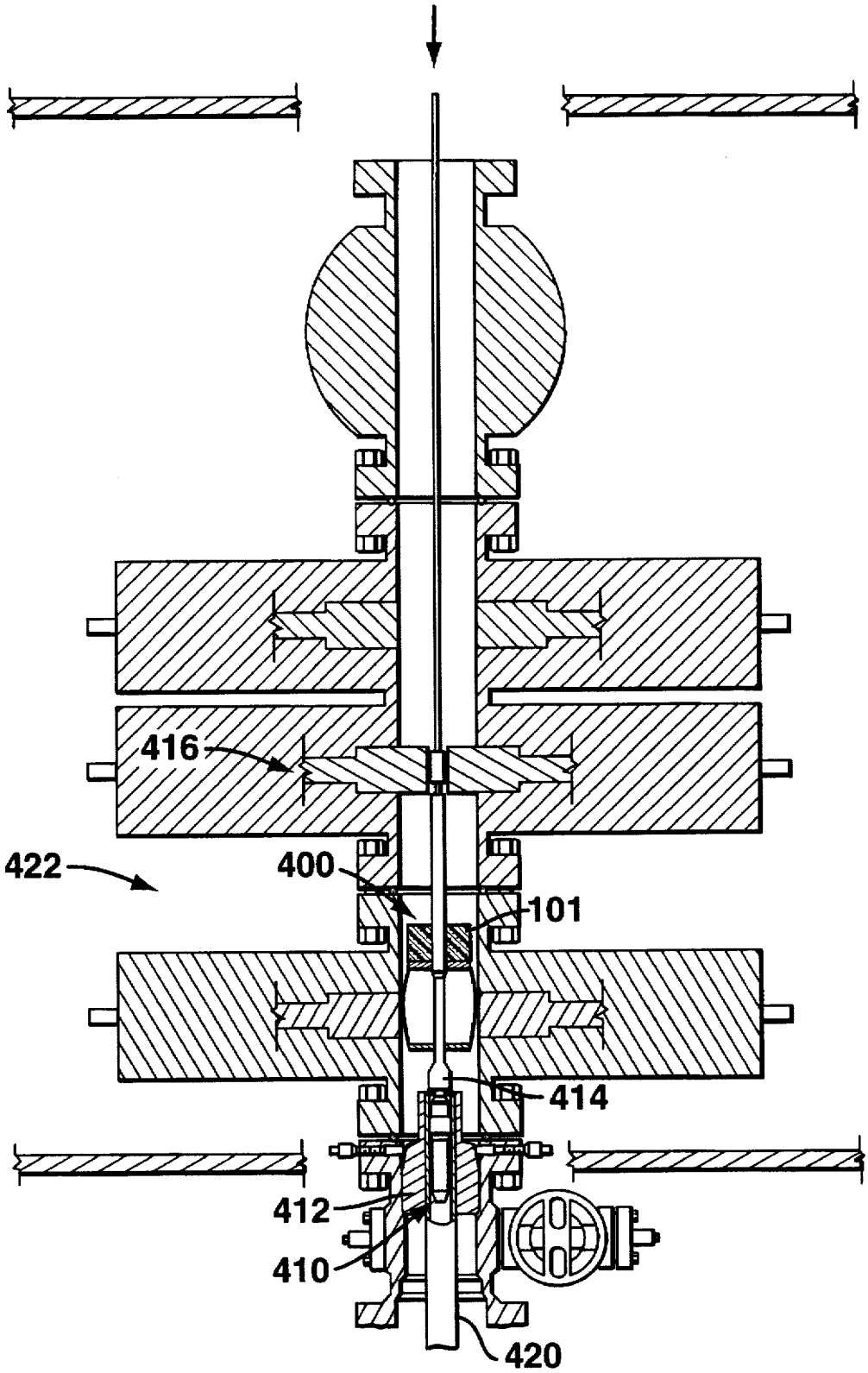
Figure 11:
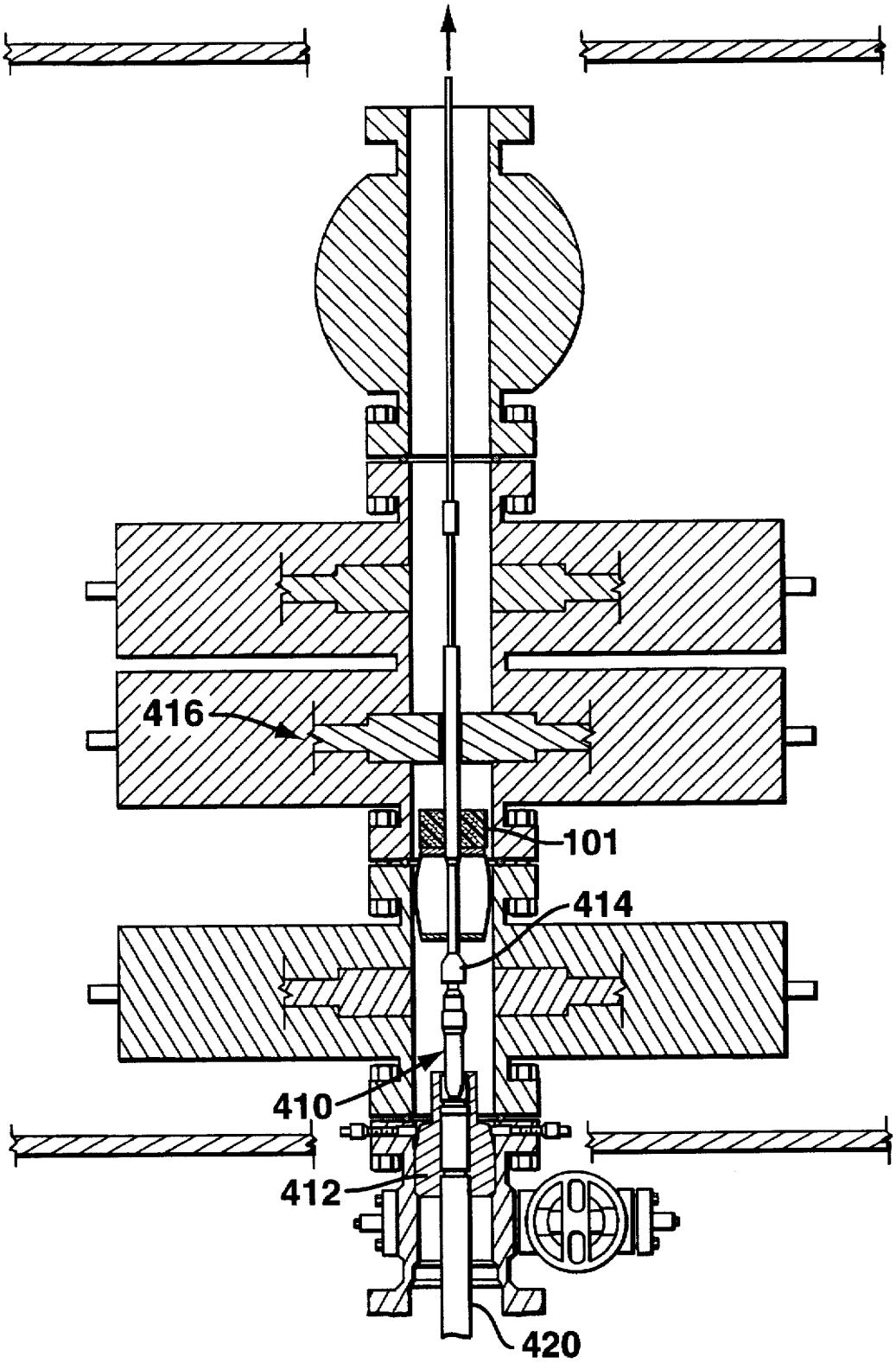
Figure 12:
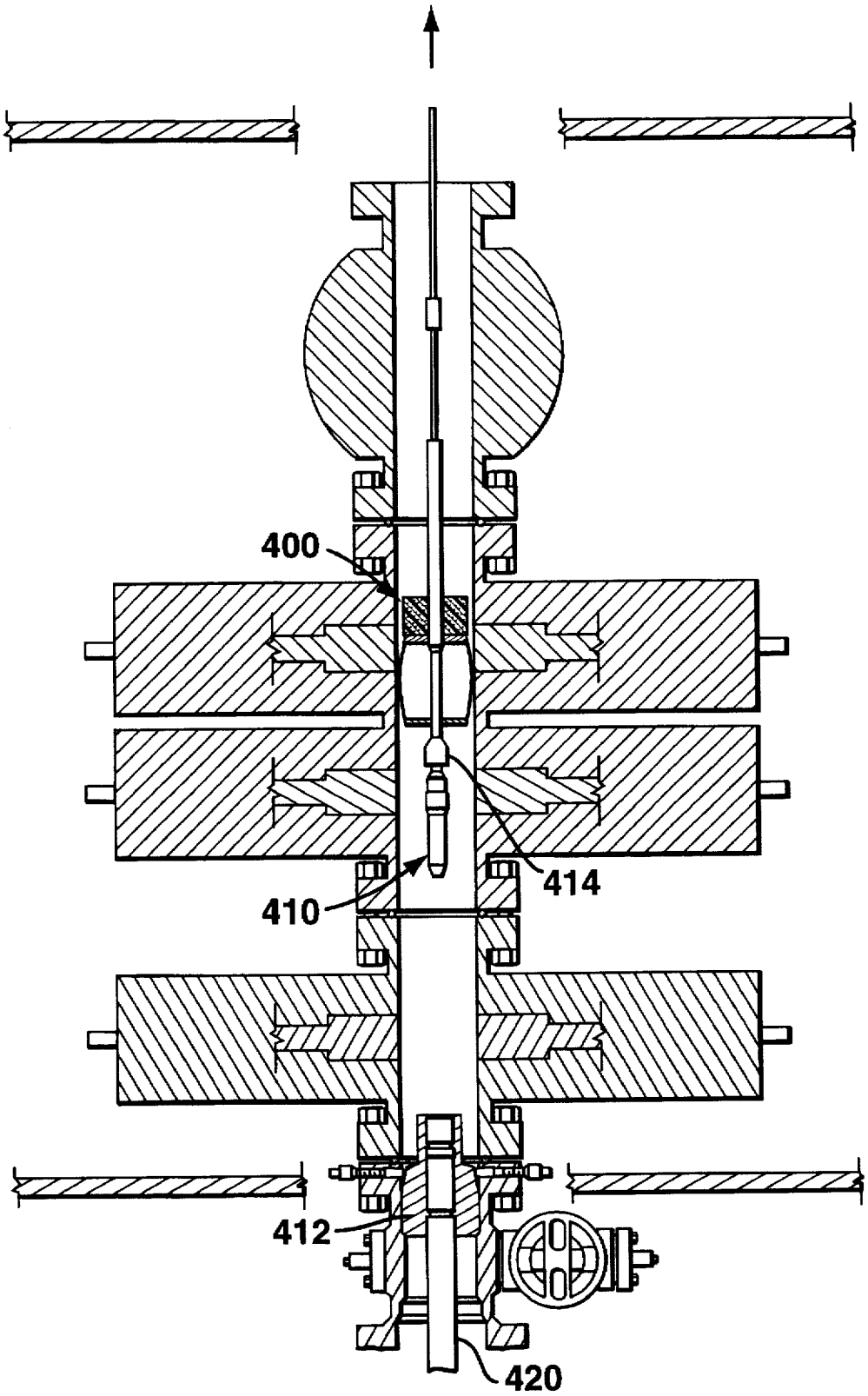

FIG. 8 illustrates the centralizer 400 and a retrieval tool 414 being lowered through the BOP stack 422 to retrieve the BPV 410. As shown in FIG. 9 the pipe ram 416 is closed above the centralizer 400 and tool 414 to prevent a blowout caused by inadvertent pressure. FIGS. 10 and 11 illustrate engagement and removal of the BPV 410 by the retrieval tool 414. In the event that a blowout occurs, the bumper 101 will impact the closed pipe ram 416. The collapsible properties of the bumper 101 will minimize or prevent damage to the pipe ram 416 and other structures from occurring. FIG. 12 illustrates full removal of the BPV.

While the preferred embodiment of the invention has been herein shown and described, it is understood that variations and modifications may be made without departure from the scope of the claimed invention.

What is claimed is:

1. A guide for use with a down-hole tool in communication with a string, the guide comprising:

a top collar connected to a bottom collar by a shroud having a plurality of flexible members which bow outwardly from the collars to centralize the guide within a hole;

a mandrel received centrally within said top and bottom collars with a first end adapted to attach to said string and a second end adapted to attach to said down-hole tool; and an energy absorbing means supported above said top collar for cushioning the impact between the guide and a down-hole structure in the event of a pressure surge in said hole, said energy absorbing means being permanently deformable in response to said impact.

2. A device as in claim 1 wherein the energy absorbing means comprises a collapsible member.

3. A device as in claim 2 wherein the collapsible member comprises a plurality of hollow columns which are hexagonal in cross-section.

* * * * *